US006350175B2

(12) United States Patent
Johnson et al.

(10) Patent No.: US 6,350,175 B2
(45) Date of Patent: Feb. 26, 2002

(54) DEVICE AND METHOD FOR CONCEALING BODILY PROTRUSIONS

(76) Inventors: S. Kraig Johnson; Sheila A. Johnson, both of 4654 Old Looney Mill La., Birmingham, AL (US) 35243

( * ) Notice: Subject to any disclaimer, the term of this patent is extended or adjusted under 35 U.S.C. 154(b) by 0 days.

(21) Appl. No.: 09/818,153

(22) Filed: Mar. 27, 2001

Related U.S. Application Data

(60) Provisional application No. 60/192,998, filed on Mar. 28, 2000.

(51) Int. Cl.[7] ..... A41C 3/12
(52) U.S. Cl. ..... 450/81; 450/57
(58) Field of Search ..... 450/81, 57, 37; 2/267, 268

(56) References Cited

U.S. PATENT DOCUMENTS 2,869,553 A * 1/1959 D'or ..... 450/81
4,333,471 A 6/1982 Nakai
4,553,550 A 11/1985 Hattori
4,557,267 A 12/1985 Cole
4,640,288 A 2/1987 Hattori
5,221,227 A 6/1993 Michels
5,326,305 A 7/1994 Fochler
5,743,272 A 4/1998 Kocher
5,782,672 A 7/1998 Woodley
5,798,062 A 8/1998 Thielbar
5,824,075 A 10/1998 Thielbar
5,847,404 A 12/1998 Grady
5,998,693 A * 12/1999 Zagame ..... 450/81 X

* cited by examiner

*Primary Examiner*—Gloria M. Hale
(74) *Attorney, Agent, or Firm*—Bradley Arant Rose & White LLP

(57) ABSTRACT

A flexible material having adhesive coated over a major portion of one side, which may then be adhered to a nipple or protrusion in a manner that allows the adhesive to directly contact the nipple (or protrusion) as well as the immediately surrounding areola and skin surface. The adhesion between the fabric and the skin, from the areas surrounding the nipple to the center of the nipple itself, creates a continuous, substantially flat (or, more particularly, a continuous curve that follows the natural curve of the surrounding tissue) profile. A preferred configuration for the device of the present invention is also provided, which reduces folding and buckling of the device as applied.

5 Claims, 8 Drawing Sheets

DEVICE AND METHOD FOR CONCEALING BODILY PROTRUSIONS

This application claims the benefit of the inventor/applicant's previously filed and copending PROVISIONAL APPLICATION, which was filed Mar. 28, 2000 in the name of S. Kraig Johnson and Sheila A. Johnson as joint inventors and applicants, and which bears provisional application Ser. No. 60/192,998.

BACKGROUND OF THE INVENTION

1. Field of the Invention

This invention relates to the protection and concealment of bodily protrusions. More particularly, the invention is directed toward a method and apparatus for obfuscating, hiding, and otherwise concealing a nipple or undesirable raised moles, warts, and growths. This invention accordingly has application to any person that may wish to wear clothing that would otherwise allow the protrusion, profile image, or "tenting" of the garment over such bodily protrusions. For the sake of brevity, the following discussion is couched primarily in terms of nipple concealment, but it should be understood that the invention has application to any type of skin protrusion.

2. Description of Related Art

The prior art regarding concealment of protrusions has been directed primarily toward addressing the often embarrassing problems associated with the tendency of the nipple to become erect in response to various stimuli, including abrasion and cold temperature. In recognition of these problems, numerous solutions have been proposed in the art as can be categorized generally into three types of approach: padded concealment, supporting concealment, and adhesive-edged constriction. These three approaches are often found in combination in individual devices.

Padded concealment "solutions" include padded or foam devices that mimic the smooth curve of the skin surrounding the nipple or protrusion at a distance from the skin intended to allow the nipple enough room to erect into the pad. Because the nipple's erection compresses the pad, a tenting effect can be avoided. A common drawback of these padded solutions is the very presence of a pad. The pad may occasionally create an unnatural curve. Furthermore, the pad is inappropriate for some clothing, such as relatively low-cut or "open" garments and swimwear. A particular combination of padded solution and constriction solution is well-known to women, who for years have employed bandage strips, often commonly referred to by the trademark BAND-AID, to provide resistance to such erection where traditional undergarments such as brassieres are an unacceptable option. The common use of such bandage strips is noted in U.S. Pat. Nos. 4,640,288 and 4,553,550, both issued to Morihisa Hattori. Bandage strips provide an exemplary platform for discussing the drawbacks of the prior art.

Bandage strips carry with them at least three unacceptable disadvantages: (1) The evidence of nipple erection remains obvious beneath sheer and lightweight fabrics; (2) attachment and wearing of the bandage strip is uncomfortable and painful; and (3) if the bandage strip is applied when the nipple is in a relaxed state (non-erect), "tenting" of the bandage strip will still occur.

With respect to the first problem, the padded area of the bandage strip, which is often rectangular, exhibits a tendency to lift in response to the erection of the nipple, which lifting creates a tenting effect of the bandage strip; the profile of the padded portion of the bandage strip is therefore visible through such sheer and lightweight fabrics. Even if no appreciable "tenting" occurs, the bandage retains its own depth, and consequently has a profile above the skin. Particularly under sheer and lightweight garments, even a slight profile is unacceptable. Even if not noticeable to someone other than the wearer, the wearer is likely to be self-conscious about the profile, which may result in reduced confidence and less enjoyment of an evening. This heightened profile is common to bandage strips and virtually all other solutions to the problem of nipple erection. Such a heightened profile is undesirable for numerous reasons, including unnatural look (particularly with rectangular padded bandages), detraction from the appeal of the unaltered breast, or perceived incompatibility with intimate moments upon removal of garments. Rather than concealing the nipple, therefore, the heightened profile of a bandage strip, or other device that has a profile, actually draws additional attention to the area, exacerbating the problem, rather than solving it. This problem is even more prevalent due to the propensity of most solutions to allow some degree of "tenting," that further exacerbates the problem.

The second problem is usually attributed to the fact that adhesive is employed in the nipple region. In the prior art, this was often uncomfortable and painful. In order to minimize the tenting effect and the unnatural profile, women occasionally employ small round bandage strips. These small strips emphasize a problem they share in common with traditional rectangular strips; namely, that the adhesive is painful and uncomfortable, especially during removal.

The third problem common to most concealment attempts is "tenting." Even when applied properly, a bandage or prior art device that has an area around the nipple free of adhesive will exhibit a propensity to allow the nipple to erect beneath the adhesive-free area. The surrounding (edged) adhesive thus remains intact with the surrounding tissue, but the adhesive-free area lifts off of the skin. The result is a relatively smooth curvature of breast along the areas having adhesive, but a relatively pointed "peak" characterizing the adhesive-free area. Such a peak is obviously unacceptable as it is unnatural in appearance and attracts unwanted attention.

Often found in connection with padded concealment, some have attempted to solve the problem of nipple erection and growth protrusions by devices that support the breast or other body part. The structure of the device may often be rigid enough or dense enough to obscure any erection or protrusion. Such supporting concealments are often used in conjunction with padding, which may be as simple as a thick fabric. It should be understood that some devices falling within the supporting concealment category may be as simple as a plastic shield that prevents the erection from protruding. The common disadvantage of supporting concealments, whether brassiere-type or shield-based, is the obviousness and visibility of the concealment. Such devices can often be seen beneath the clothing, and are difficult to orient in a fashion that would allow low-cut garments to be worn. Additionally, in certain instances women may not want a support function or may object to relatively rigid devices for various reasons of flexibility, comfort, and look.

Finally, many in the prior art have focused upon the use of adhesives to ensure compression of the nipple. The unifying characteristic of the embodiments and teachings of this approach is the perceived need to avoid application of the adhesive directly to the nipple itself, or to the protruding growth. This perceived need is due to two assumptions. First, it is assumed that, because preventing irritation of the erect nipple is a goal of the device, use of any adhesive on the nipple surface itself would be unacceptable due to pain during removal. Second, the prior art assumes that adhesively securing the edges of a concealment device to the surrounding skin will adequately obscure or prevent the protrusion of an erect nipple or growth. Each of these assumptions is incorrect and exacerbates the problems of tenting, profile, and discomfort. The present invention solves all of the mentioned problems by employing adhesive across and including the nipple surface.

OBJECTS OF THE INVENTION

The following stated objects of the invention are alternative and exemplary objects only, and should not be read as required for the practice of the invention, or as an exhaustive listing of objects accomplished.

An exemplary and non-exclusive alternative object of the invention is to provide a nipple concealment device and method that simply and painlessly obscures an erect nipple or protruding skin growth.

An exemplary and non-exclusive alternative object of the invention is to provide such a device and method that does not cause pain upon removal.

An exemplary and non-exclusive alternative object of the invention is to provide a nipple concealment device that can be easily and economically produced.

An exemplary and non-exclusive alternative object of the invention is to provide a nipple concealment device and method that can be used under sheer garments, lightweight fabric, low-cut garments, and swimwear with a substantially lowered visibility.

The above objects and advantages are neither exhaustive nor individually or jointly critical to the spirit or practice of the invention. Other objects of the invention will be obvious to those skilled in the art.

BRIEF SUMMARY OF THE INVENTION

The present invention relates to a method and device for concealing embarrassing, unsightly, attention-attracting, or undesirable skin protrusions, including erect nipples, moles, scar tissue, and growths. This invention differs substantially from the prior art due in part to the recognition that adhesive can be removably affixed directly to the nipple or protrusion itself without undue discomfort during the wearing of the device or during its removal. Furthermore, the invention capitalizes upon the realization that significant advantages flow from a concealment "patch" that has adhesive coating both the edge areas and the areas in contact with the nipple.

The present invention can be most simply described as a sheet of fabric (or any flexible material including papers) that has adhesive coated over a major portion of one side. That side is then adhered to the nipple or protrusion in a manner that allows the adhesive to directly contact the nipple (or protrusion) as well as the immediately surrounding areola and skin surface. The substantially continuous adhesion between the fabric and the skin, from the areas surrounding the nipple to the center of the nipple itself, creates a continuous, substantially flat (or, more particularly, a continuous curve that follows the natural curve of the surrounding tissue) profile. Most advantageously, the adhesive employed is a non-irritating, easily removable adhesive, such as may be commonly found in medical adhesives. The fabric can, of course, be of any color or configuration that would be beneficial for either concealment or decoration, as the wearer may desire.

DETAILED DESCRIPTION OF THE INVENTION

Figure 1:
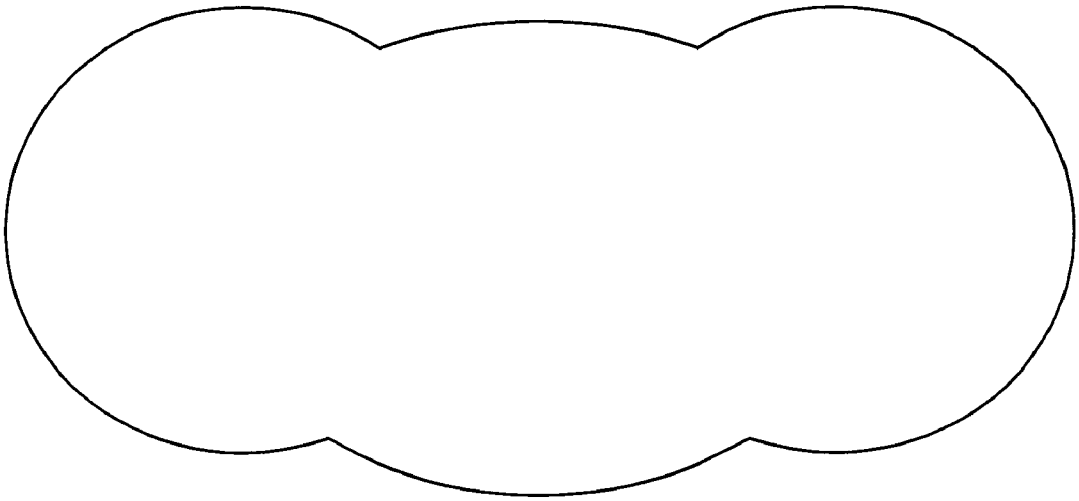
FIG. 1 is a drawing showing one of the inventors' preferred embodiment of the compression strip of the present invention.
Figure 1A:
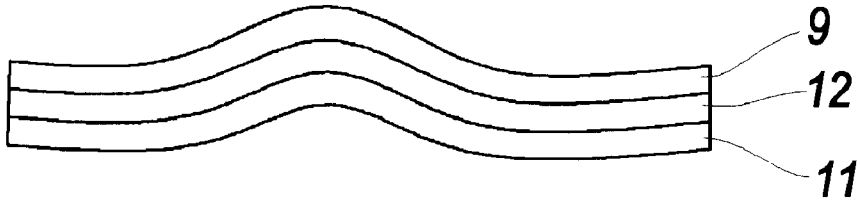
Figure 2:
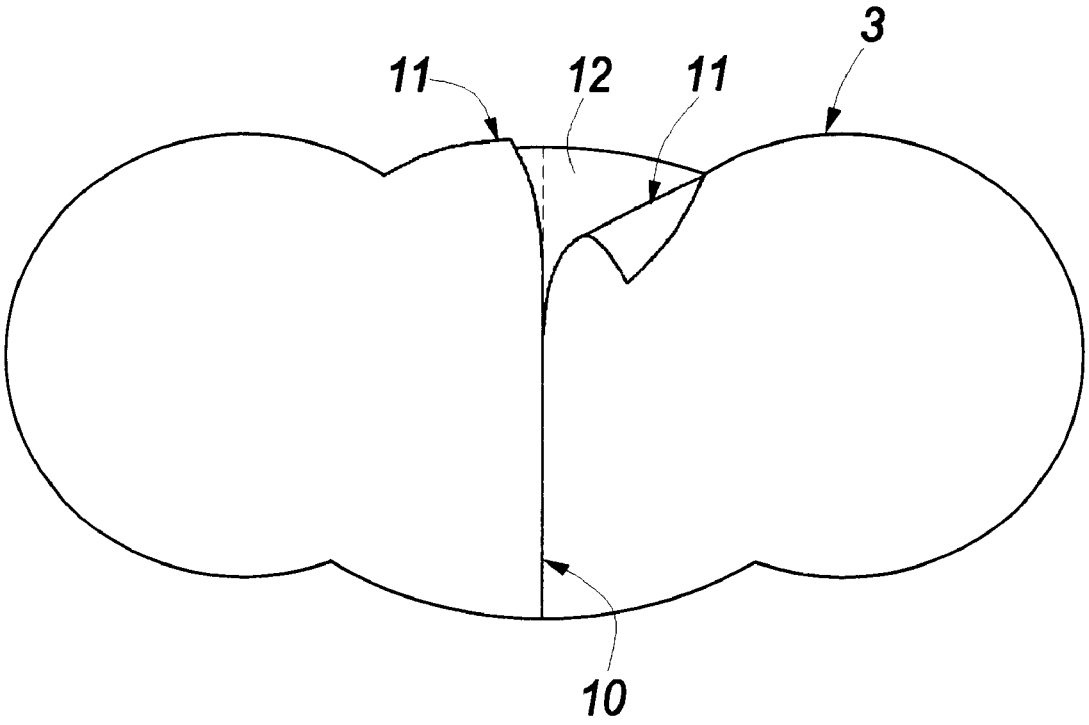
FIG. 2 represents the rear (skin-facing) view of the compression device, including a centerline perforation for a releasable backing material that is shown in liftable relation to the device for removal of the backing prior to application.
Figure 3:
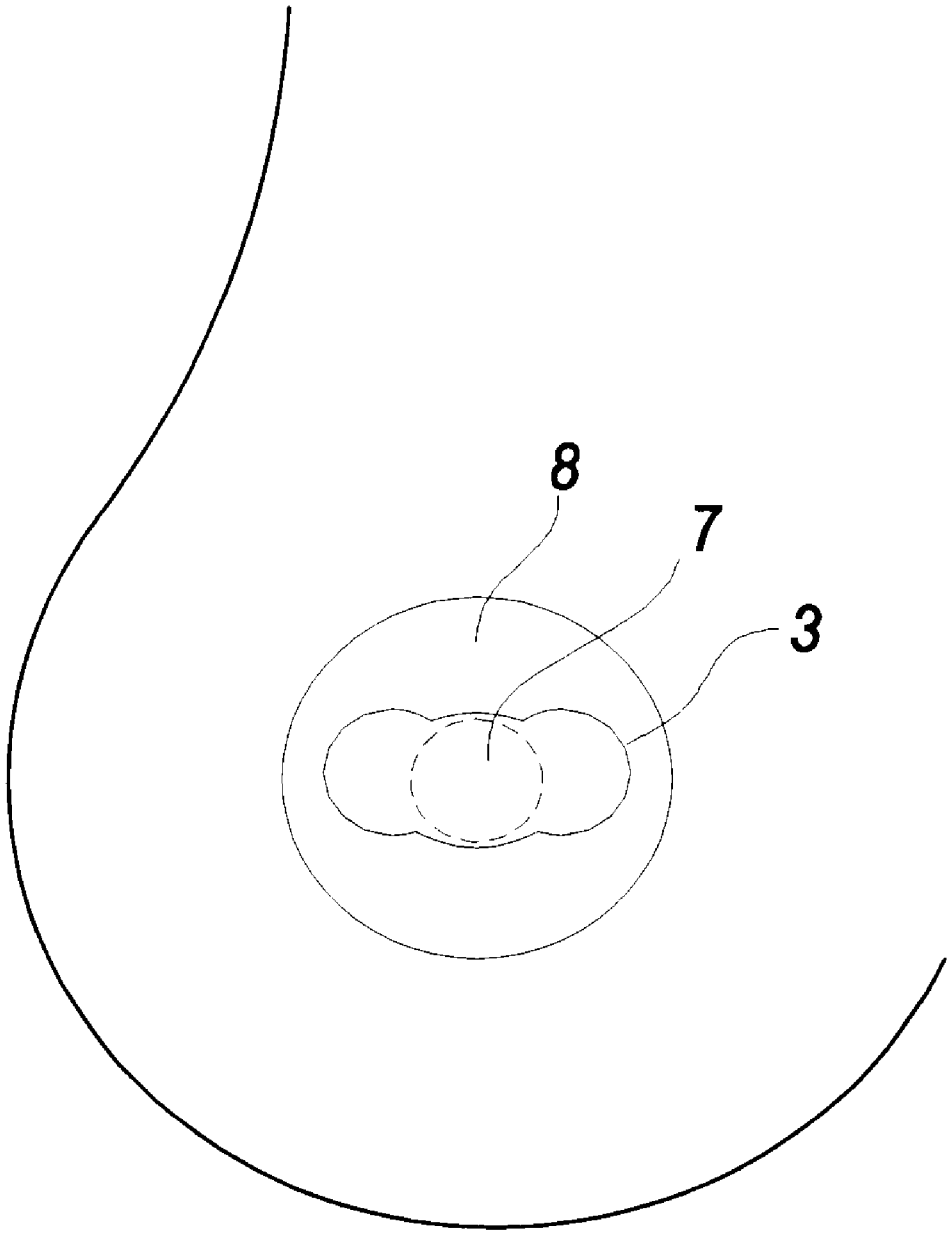
FIG. 3 depicts the invention as applied to a female nipple in the most preferred embodiment; alternative configurations and coverage capacities are acceptable.

It will be appreciated by those skilled in the art that various modifications within the spirit of the invention may be made to the embodiments which are disclosed in this section for purposes of illustration. The invention is not to be limited to those particular embodiments, but only by the scope of the appended claims and their equivalents.

Turning to the drawings, the device of the present invention is in one preferred embodiment a flexible material or fabric 9 coated with a releasable non-irritating adhesive 12 on at least one side. The inventors most prefer to select the fabric 9 from a group of commonly available professional medical adhesive fabrics, including particularly the adhesive fabric sold by 3M under the designation #1533L, though it will be recognized that any flexible material with a releasable non-irritating adhesive will suffice. In one preferred embodiment, only the skin-facing side is coated, though it is recognized that the other side may be coated as well without deviating from the spirit of the invention if such additional coating is desired to ensure non-movement of the garment above the device, or for other reasons. According to the invention, the adhesive is substantially continuous along the majority of the adhesive side, to the extent that the portion of the fabric intended or adapted for locating directly above the nipple 7 or protrusion is not free of adhesive. While the inventors prefer a continuous smooth coating of adhesive for purposes of optimal function and ease of manufacture, the adhesive may be applied in discontinuous patterns, so long as no voids in the area intended for or adapted to receiving the nipple 7 or protrusion are great enough to receive the entire erect nipple 7 surface. Such discontinuous patterns can include dot-distribution, cross-hatching, or any other such pattern.

For shipping and storage reasons, it is desirable to shield the adhesive with a release-coated film 11 until use of the device is desired. Such a removable coating is not essential, though it is preferred to at the least provide a substrate from which the adhesive is easily removed to avoid dirt accumulation and self-adherence. To apply the device, the adhesive is exposed by removal of film 11, if any, after which the adhesive 12 on the adhesive side is then pressed firmly against the nipple 7 (or other protrusion) and the areola 8 (or other surrounding tissue).

Figure 4:
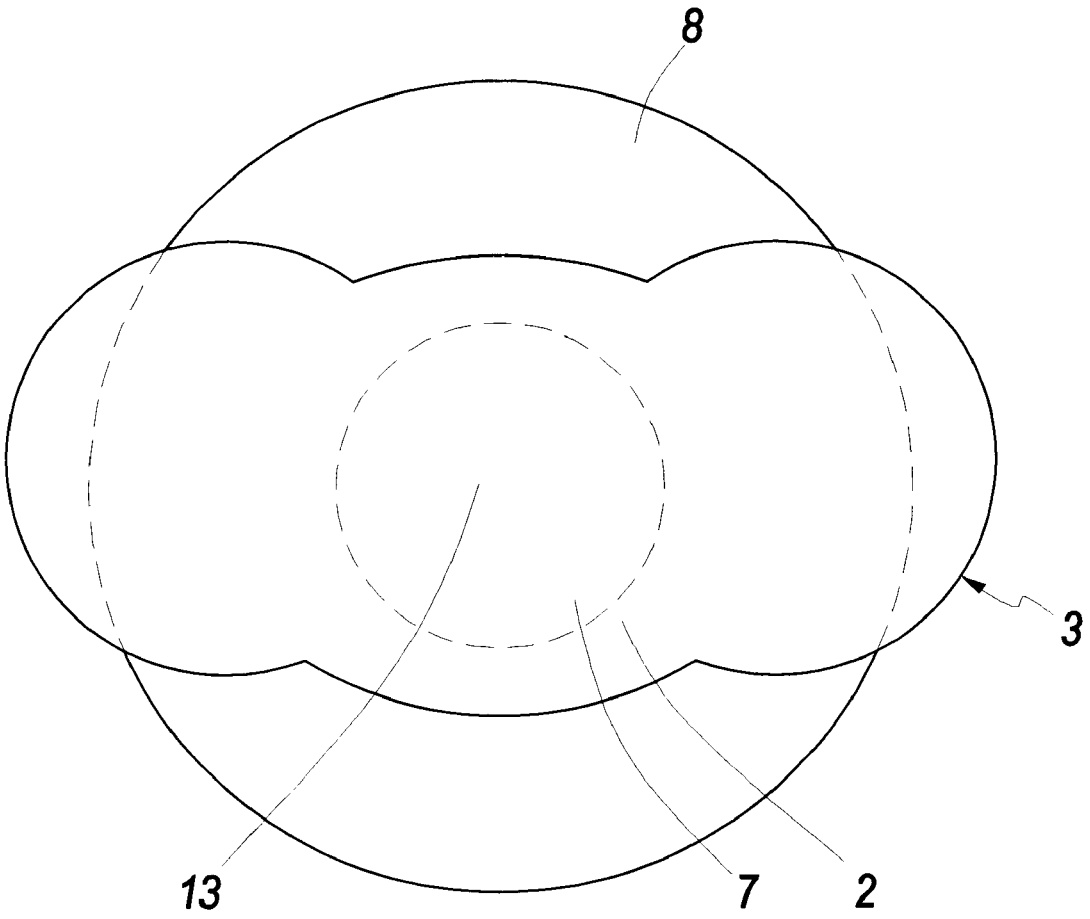
FIG. 4 portrays the invention applied in close-up view for facilitation of discussion of the adhesion properties across nipple and areola.
Figure 5:
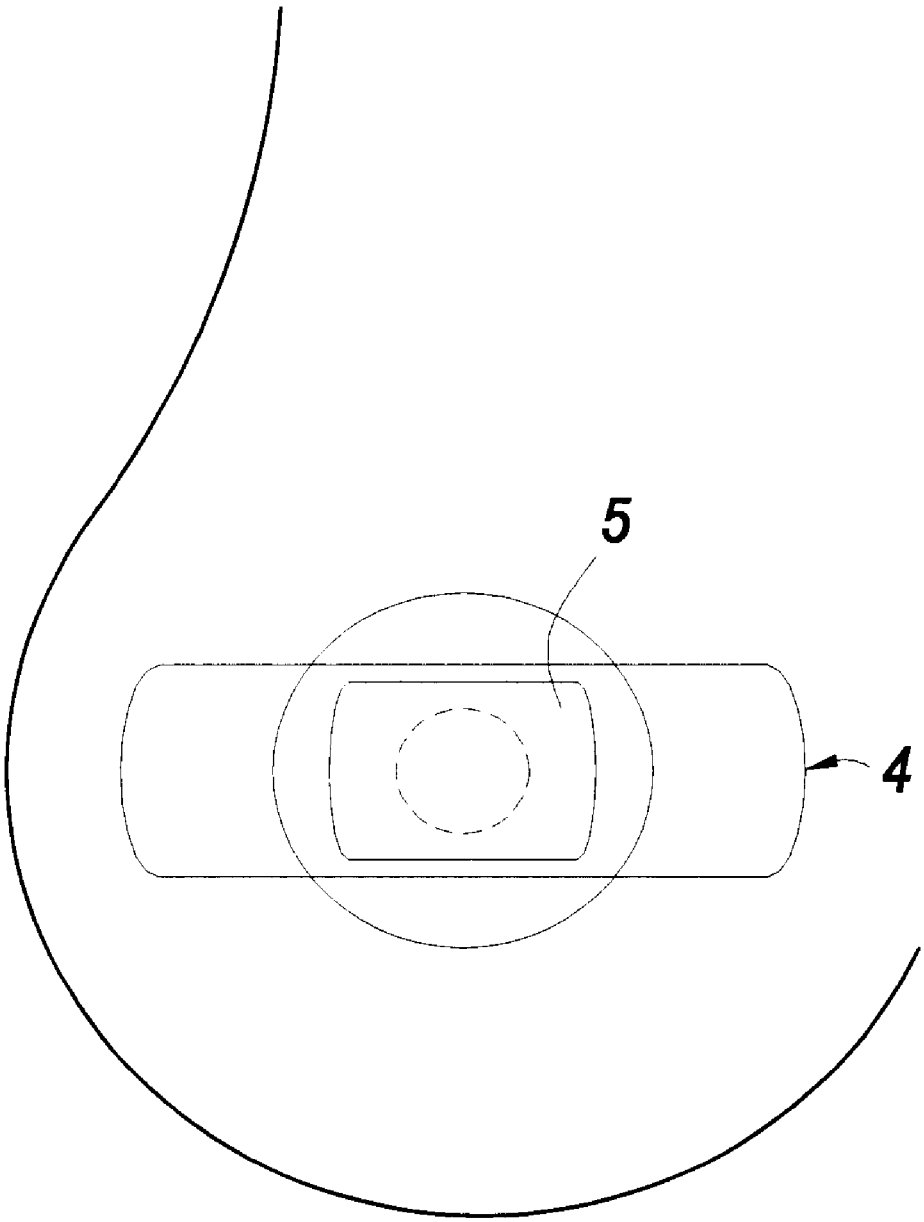
FIG. 5 highlights an example of the prior art bandage strip methodology.
Figure 8:
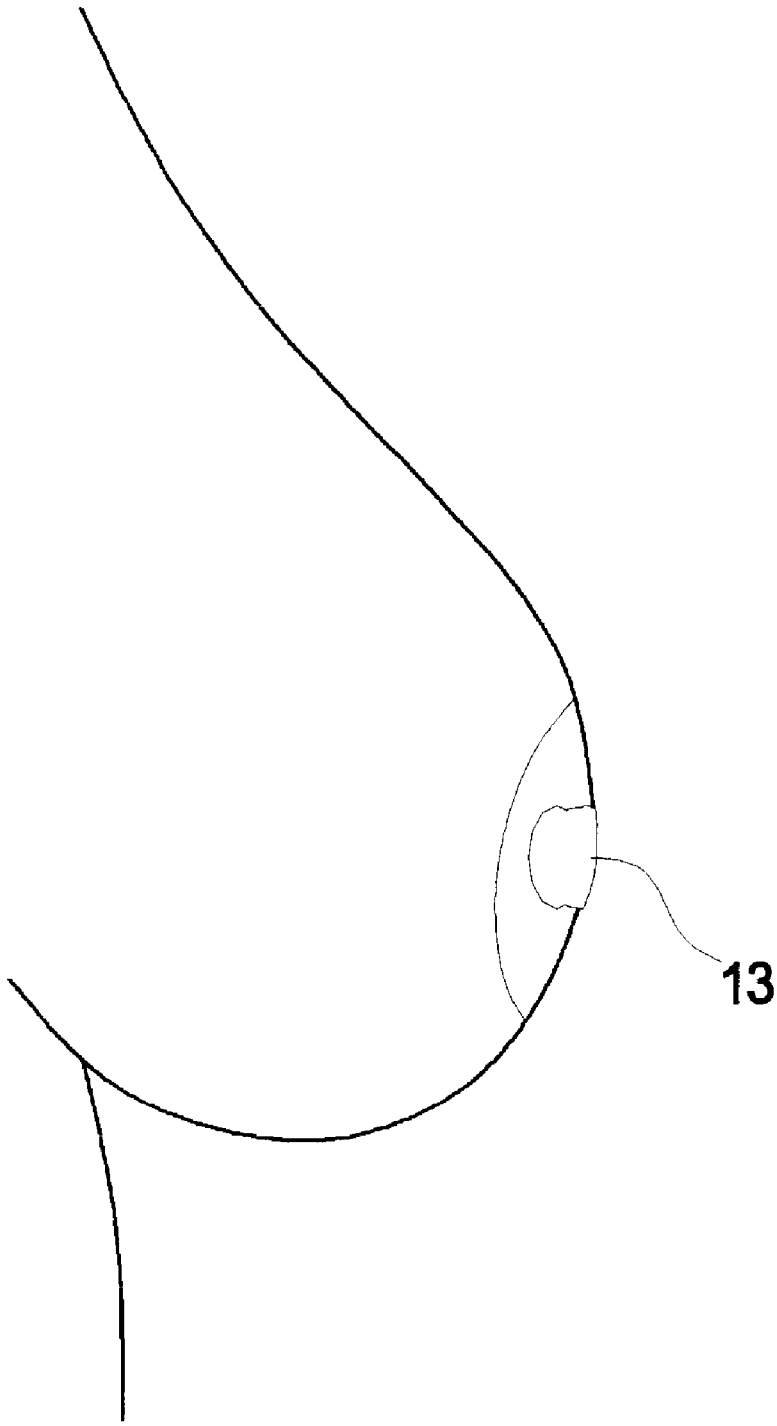
FIG. 8. displays the compression strip of the current invention in side view, whether constricted/erected or relaxed.

As can be seen most clearly from FIGS. 4 and 8, the adhesive 12 will most advantageously adhere to both the furthest extendible nipple portion 13 and the tissue 2 that is immediately adjacent to such furthest extendible nipple portion 13 when in the compressed, non-erect state. Because of the continuity of the adherence along the transition from furthest extendible nipple portion to adjacent tissue, the profile of the compressed nipple remains smooth and of reduced obviousness. Furthermore, the continuity of adherence substantially prevents appreciable "tenting" or pulling away of the material from the tissue 2 (seen in the prior art in FIG. 5). Finally, the continuous adhesion prevents stretching of the fabric 9, which would allow for noticeable protrusion, because the weave of the fabric 9 is maintained in a fixed relationship. As can be seen from FIG. 5, the profile of a device not employing adhesive directly upon the nipple 7 and areola 8 adopts a pointed configuration. This is because the non-adhered areas allow for tenting and stretching to a greater degree than allowed by the invention device and method.

By contrast, in the present invention, tenting and stretching is dynamically reduced due to the substantially continuous nature of the adhesion across the nipple 7 and surrounding tissue 8. This is in part because the continuous adhesion takes advantage of the recognition that the tension and "firmness" of the tissue immediately surrounding the erect nipple 7 increases as does the force of the erection.

Figure 6:
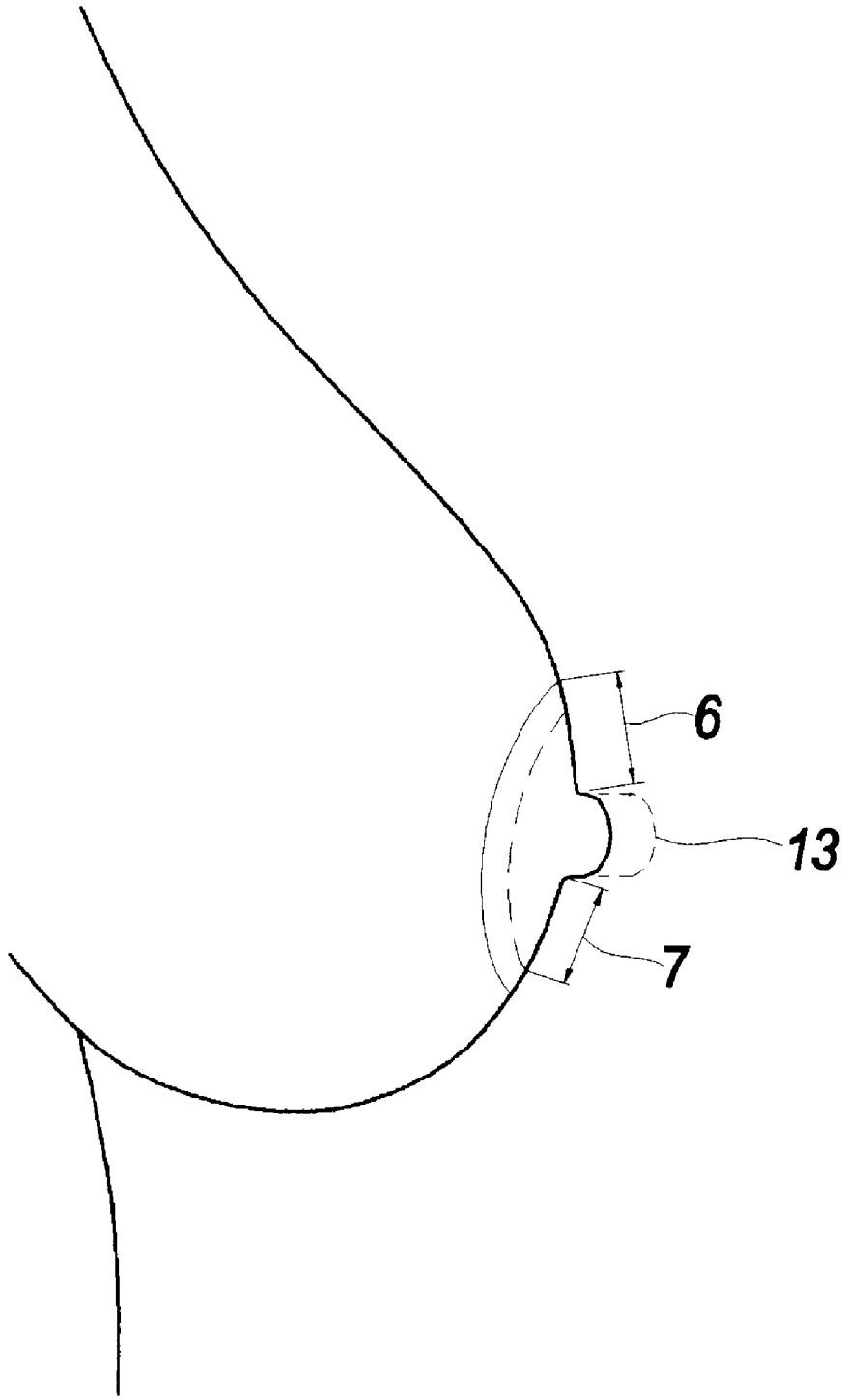
FIG. 6 provides a view of the relationship of constriction of the areola that coincides with nipple erection, from the "relaxed" state of a breast (shown in solid lines) to a constricted/erect state (shown in dotted lines).
Figure 7:
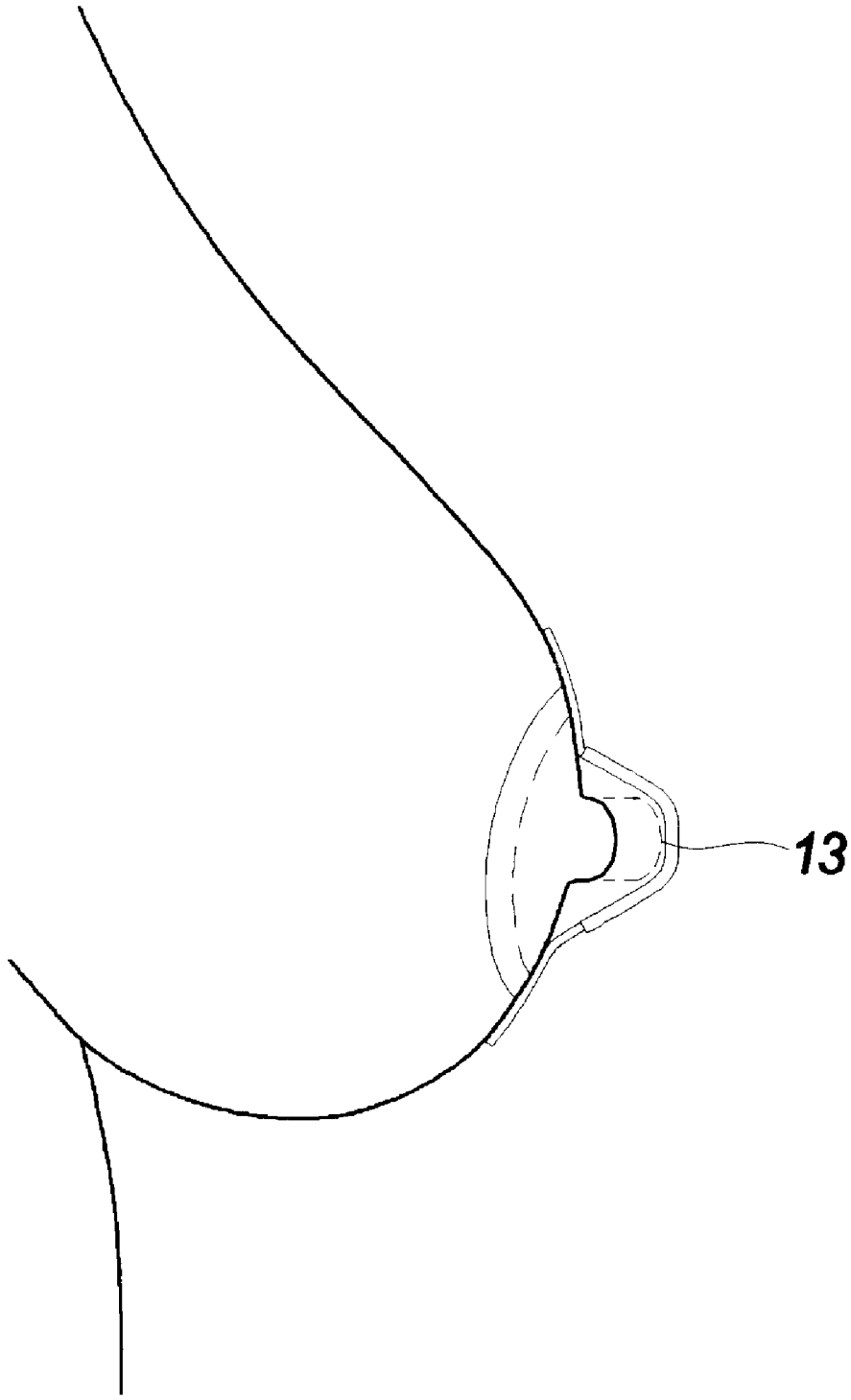
FIG. 7 demonstrates the effect of coincident areola constriction/nipple erection upon the prior art bandage strip methodology.

Furthermore, it is noted that areola 8 typically may contract during erection of the nipple 7. In such a case, the contraction tends to reduce the surface area of breast tissue underneath a traditional adhesive edged device. See FIG. 6, diagrammatically comparing the relaxed state in solid lines and the constricted/erect state. This in turn leads to slack in the center of the device, which thus allows for a more pronounced pointed tent than has been appreciated prior to this invention.

In the drawings, the fabric 9 is depicted in a multiple oval, circular, or other rounded shape. It must be understood that the shape of the device may be varied for particular applications (e.g., truncated on one side for a severely side-cut bustline), decorative or fashion reasons, or even on whim. The depicted embodiment is one preferred by the inventors for the sake of prevention of folding or buckling of the device during wear and erection/contraction of the nipple or other protrusion. Although any shape will remain within the broadest scope of the invention, the inventors recognize a special inventive advantage of the shown offset configuration of multiple of circular (or other rounded) shapes. By causing the center of a non-terminating portion to be offset from a straight midline drawn between the centers of the outermost two shapes, such folding and buckling may be reduced. The calculation of the center point of each shape need not be mathematically precise for preparing this configuration; it is sufficient that the center be determined as the appropriate two dimensional center of area of each shaped portion as if the portion were completed in absence of the other conjoined portions. Furthermore, while the depicted device as applied to a nipple does not cover the entire surface of the areola 8, the invention contemplates that larger surface area sheets may be employed within the scope of this invention.

Advantages and alternative embodiments of the present disclosure, whether to its preferred embodiment or in embodiments that shall be apparent to those in the art, and are intended to be within the scope of this invention.

We claim:

1. A skin protrusion concealment device comprising a flexible base material having an outer-facing side and a skin facing side, said skin facing side having thereon an adhesive, said device having a configuration comprising three conjoined substantially rounded shapes, wherein a first of said substantially rounded shapes and a second of said substantially rounded shapes represent terminating portions, and a third of said substantially rounded shapes represents an intermediary portion interposed between said first and second portions, and wherein further a center point of said intermediary portion does not lie in a straight line between a center point of said first portion and a center point of said second portion.

2. A skin protrusion concealment device as in claim 1, wherein the adhesive on said skin facing side covers a surface area of said skin facing side sufficient to adhere to both a skin protrusion and an area of immediately surrounding tissue.

3. A nipple protrusion concealment device comprising a flexible base material with a width no greater than approximately slightly wider than an aerola, said material comprising an outer-facing side and a skin-facing side, said skin-facing side having thereon an adhesive covering a sufficient surface area to adhere substantially continuously across a nipple and an areola, while leaving a non-areola breast area substantially free of adhesive.

4. A method for reducing the profile of a protrusion from skin comprising the step of adhering a flexible material across substantially only said protrusion and an area of immediately surrounding tissue, wherein said material is adhered directly to said protrusion and to the immediately surrounding tissue.

5. A method as in claim 4, wherein said protrusion acted upon is a nipple and said area of immediately surrounding tissue includes at least an areola.

* * * * *